US011009195B2

(12) United States Patent
Cheng

(10) Patent No.: US 11,009,195 B2
(45) Date of Patent: May 18, 2021

(54) APPARATUS FOR SIMULATING AN OPEN CANDLE FLAME

(71) Applicant: Universal Candle Company Limited, Hong Kong (CN)

(72) Inventor: Chak-yin Cheng, Hong Kong (CN)

(73) Assignee: Universal Candle Company Limited, Hong Kong (CN)

( * ) Notice: Subject to any disclaimer, the term of this patent is extended or adjusted under 35 U.S.C. 154(b) by 0 days.

(21) Appl. No.: 16/948,078

(22) Filed: Sep. 2, 2020

(65) Prior Publication Data

US 2021/0102672 A1 Apr. 8, 2021

Related U.S. Application Data

(60) Provisional application No. 62/909,838, filed on Oct. 3, 2019.

(51) Int. Cl.
*F21S 6/00* (2006.01)
*F21S 10/04* (2006.01)
*F21W 121/00* (2006.01)

(52) U.S. Cl.
CPC ..... *F21S 6/001* (2013.01); *F21S 10/046* (2013.01); *F21W 2121/00* (2013.01)

(58) Field of Classification Search
CPC ..... F21S 6/001; F21S 10/04; F21S 10/043; F21S 10/046; F21W 2121/00; F21V 33/0004; F21V 33/0012; F21V 33/0024; F21V 33/0028; F21V 33/0048; F21V 14/02; F21V 14/025; F21V 14/04; F21V 14/045; F21V 21/30; F21V 35/00; F21V 35/003; F21V 35/006
See application file for complete search history.

(56) References Cited

U.S. PATENT DOCUMENTS 4,551,794 A * 11/1985 Sandell ..... F21S 10/04 362/392
7,159,994 B2 1/2007 Schnuckle et al.
8,550,660 B2 10/2013 Patton et al.
9,366,402 B2 6/2016 Li
(Continued)

FOREIGN PATENT DOCUMENTS

CN 207990443 U * 10/2018 ..... F21S 6/001

OTHER PUBLICATIONS

Ding, Electronic candle sways, Oct. 19, 2018, CN-207990443-U, English (Year: 2018).*
(Continued)

*Primary Examiner* — Bryon T Gyllstrom
*Assistant Examiner* — James M Endo
(74) *Attorney, Agent, or Firm* — S&F/WEHRW

(57) ABSTRACT

An apparatus for simulating an open candle flame having a swing holder located within a casing and engaging with a connecting rod, the connecting rod pivotally and rotatably connecting to the swing holder to form a first pivot structure for allowing the connecting rod to turn about a first axis, the swing holder pivotally and rotatably connecting to the casing to form a second pivot structure for allowing the swing holder and the connecting rod to turn about a second axis. The swinging mechanism of the apparatus is able to minimize the cost and the number of parts, ease and simplify assembly, and insure the flame display stays in place after manufacturing and during transit and handling.

22 Claims, 21 Drawing Sheets

(56) References Cited

U.S. PATENT DOCUMENTS

| | | | | |
|---|---|---|---|---|
| 9,512,971 | B2 | 12/2016 | Li | |
| 9,523,471 | B2 | 12/2016 | Li | |
| 10,520,150 | B2 | 12/2019 | Huang et al. | |
| 10,533,718 | B2 | 1/2020 | Li | |
| 2002/0075690 | A1* | 6/2002 | Mullen | F21V 21/30 362/427 |
| 2006/0034100 | A1* | 2/2006 | Schnuckle | B44C 5/06 362/161 |
| 2014/0177212 | A1* | 6/2014 | Li | H05B 47/16 362/190 |
| 2014/0362592 | A1* | 12/2014 | Lee | F21L 4/08 362/386 |
| 2015/0204498 | A1* | 7/2015 | Hau | F21S 10/046 362/650 |
| 2016/0116127 | A1* | 4/2016 | Patton | F21S 6/001 362/284 |
| 2016/0258586 | A1* | 9/2016 | Patton | F21S 10/046 |
| 2016/0312969 | A1* | 10/2016 | Patton | H05B 47/105 |
| 2017/0089548 | A1* | 3/2017 | Yang | F21L 4/02 |
| 2017/0122511 | A1* | 5/2017 | Ding | F21V 17/002 |
| 2017/0159901 | A1* | 6/2017 | Li | F21S 10/046 |
| 2017/0307159 | A1* | 10/2017 | Li | F21S 10/046 |

OTHER PUBLICATIONS

"Sharper Image 3X4.5 Flicker Flame LED" Web page <https://www.athome.com/3x4.5-flicker-flame-ed/124235692.html>, 1 page, the product first known to applicant in Jun. 2019, retrieved from Internet Archive Wayback Machine <https://web.archive.org/web/20200916072508/https://www.athome.com/3x4.5-flicker-flame-ed/124235692.html> on Sep. 16, 2020.

"Classic Flickering Flameless Wax Pillar Candle" Web page <https://www.potterybarn.com/products/classic-flameless-pillar-candles/?pkey=s%7Cclassic%20flameless%7C6>, 1 page, the product first known to applicant in May 2020, retrieved from Internet Archive Wayback Machine <http://web.archive.org/web/20200916075842/https://www.potterybarn.com/products/classic-flameless-pillar-candles/?pkey=s%7Cclassic+flameless%7C6> on Sep. 16, 2020.

"3d Flameless Candle" Web page <https://www.pier1.com/pages/search-results?q=3d%20flameless%20candle>, 1 page, the product first known to applicant in Jun. 2019, retrieved from Internet Archive Wayback Machine <http://web.archive.org/web/20200916083337/https://www.pier1.com/pages/search-results?q=3d+flameless+candle> on Sep. 16, 2020.

* cited by examiner

APPARATUS FOR SIMULATING AN OPEN CANDLE FLAME

CROSS-REFERENCE TO RELATED APPLICATIONS

This application claims the benefit of U.S. Provisional Patent Application No. 62/909,838, filed on Oct. 3, 2019, which is incorporated by reference herein in its entirety.

TECHNICAL FIELD

The present disclosure generally relates to an apparatus for simulating an open candle flame.

BACKGROUND

An open candle flame simulation lies on the fidelity to simulate the subtle concept that candles burning with different flames have many different meanings and functions. The way that a candle burns holds hidden significance as they can glow dull or shine bright at different time.

Conventionally, the open candle flame simulation uses a flame display and a lighting device, and the flame display is actuated and swung under the illumination of the lighting device for simulating an open candle flame. However, having an effective means for actuating the swing of the flame display to look more realistic as that of a real candle is always a challenge. The conventional swinging mechanisms have complicate structures requiring many components and labor force to assembling them together, which substantially increase production cost. Additionally, many swinging mechanisms fail to provide rigid structure, leading to components coming loose.

A need therefore exists for an improved apparatus for simulating an open candle flame that eliminates or at least diminishes the disadvantages and problems described above.

SUMMARY OF THE INVENTION

Provided herein is an apparatus for simulating an open candle flame comprising: a casing; a connecting rod; a flame display located above the casing and attached to an upper end of the connecting rod; a light source located within the flame display or connecting to the casing for generating light to illuminate the flame display; a balance weight attached to a lower end of the connecting rod; a swing holder located within the casing and engaging with the connecting rod, the connecting rod pivotally and rotatably connecting to the swing holder to form a first pivot structure for allowing the connecting rod to turn about a first axis, the swing holder pivotally and rotatably connecting to the casing to form a second pivot structure for allowing the swing holder and the connecting rod to turn about a second axis; a magnet attached to the balance weight; and a coil located adjacent to the magnet for generating an electromagnetic field interacting with a magnetic field of the magnet for driving the connecting rod to turn about the first axis and the second axis so as to swing the flame display for simulating the open candle flame.

In certain embodiments, the connecting rod comprises two rod protrusions located along the first axis; and the swing holder comprises two holder slots located along the first axis, the two rod protrusions being located within the two holder slots to form two first swing joints respectively thereby forming the first pivot structure.

In certain embodiments, the swing holder comprises two holder protrusions located along the second axis; and the casing comprises two casing slots located along the second axis, the two holder protrusions being located within the two casing slots to form two second swing joints respectively thereby forming the second pivot structure.

In certain embodiments, the two rod protrusions are attached to lateral sides of the connecting rod respectively; and the two holder slots are located at lateral sides of the swing holder respectively.

In certain embodiments, the two holder protrusions are attached to lateral sides of the swing holder respectively; and the two casing slots are located at lateral sides of the casing respectively.

In certain embodiments, the first axis is substantially perpendicular to the second axis.

In certain embodiments, an angle between the first axis and the second axis is between 80° and 100°.

In certain embodiments, each of the rod protrusions has an edge for contacting a respective holder slot.

In certain embodiments, each of the holder protrusions has an edge for contacting a respective casing slot.

In certain embodiments, each of the holder slots is circular or V-shaped.

In certain embodiments, each of the holder slots is spiral-shaped.

In certain embodiments, at least one of the holder slots has an opening having a width less than a width of a respective rod protrusion.

In certain embodiments, each of the casing slots is circular or V-shaped.

In certain embodiments, the casing comprises an upper case and a lower case.

In certain embodiments, each of the casing slots is located on the top edge of the lower case and closed by the bottom edge of the upper case so as to prevent the holder protrusion from coming loose.

In certain embodiments, the upper case and the lower case are connected by a plurality of pins and sockets.

In certain embodiments, the upper case has a top hole having a first width and a second width, the first width being large enough to allow the flame display to pass through the top hole, the second width being small enough to prevent the first pivot structure to pass through after rotating the upper case to a final position of assembly.

In certain embodiments, the coil is located below the magnet.

In certain embodiments, the center of the coil is offset from a vertical axis of the magnet with an offset distance.

In certain embodiments, the electromagnetic field is a time-varying electromagnetic field.

In certain embodiments, the apparatus further comprises a driver for providing electric current to the coil.

In certain embodiments, the apparatus further comprises a printed circuit board containing the driver.

In certain embodiments, the apparatus further comprises a light holder and lens, the light source and the lens being located within the light holder, the light holder attached to the casing, the lens being used for focusing the light on the flame display.

In certain embodiments, the apparatus further comprises a light holder and lens, the light source and the lens being located within the light holder, the light holder being located between the upper case and the lower case, the lens being used for focusing the light on the flame display.

In certain embodiments, the flame display comprises a flame casing, the light source being located within the flame casing.

In certain embodiments, the apparatus further comprises a housing, the casing being located within the housing, the flame display being located above or on the surface of the housing.

These and other aspects, features and advantages of the present disclosure will become more fully apparent from the following brief description of the drawings, the detailed description of certain embodiments.

BRIEF DESCRIPTION OF DRAWINGS

The appended drawings contain figures of certain embodiments to further illustrate and clarify the above and other aspects, advantages and features of the present invention. It will be appreciated that these drawings depict embodiments of the invention and are not intended to limit its scope. The invention will be described and explained with additional specificity and detail through the use of the accompanying drawings in which.

DETAILED DESCRIPTION OF THE INVENTION

Figure 1A:
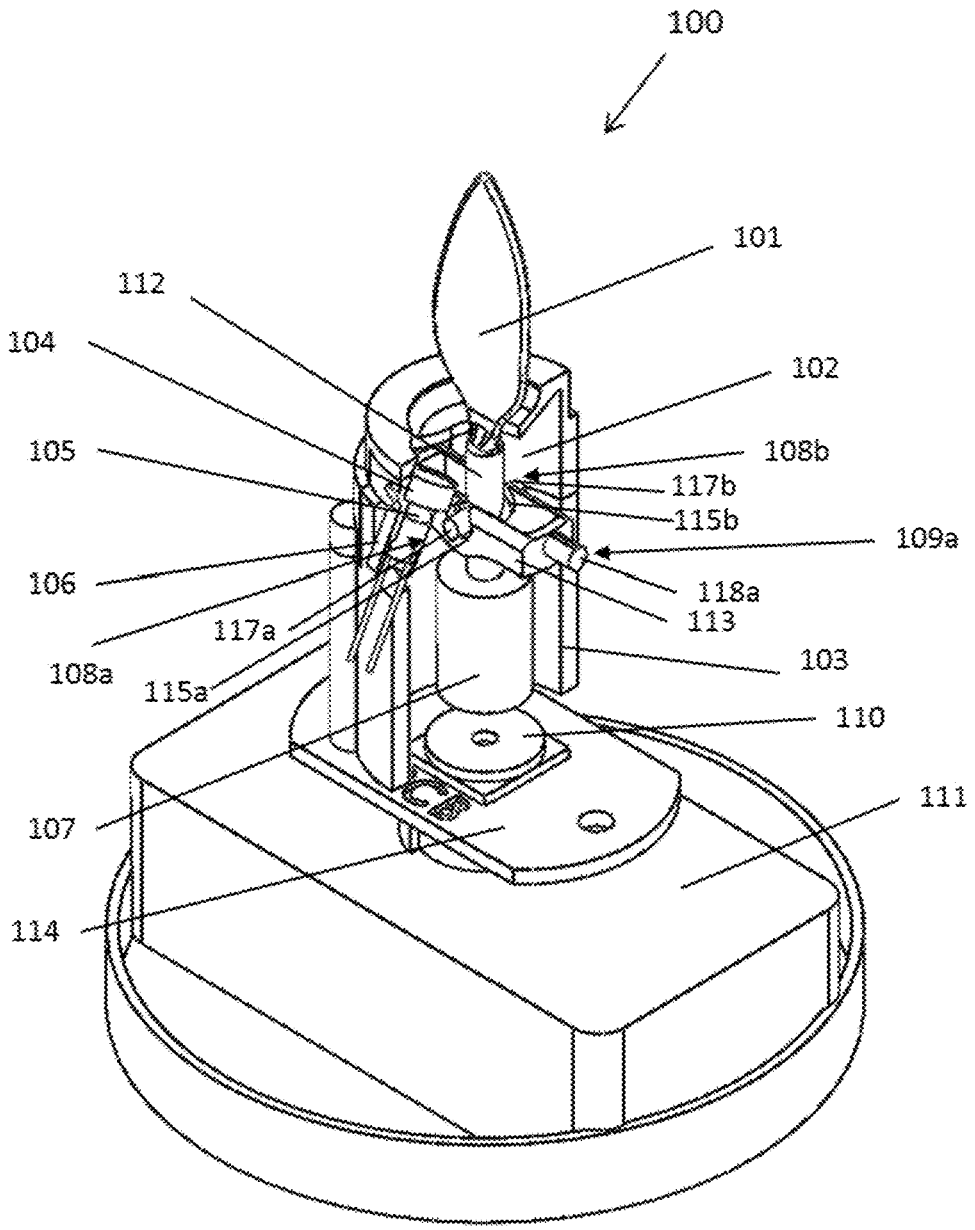
FIG. 1A is a schematic diagram depicting an apparatus for simulating an open candle flame according to certain embodiments.

The present disclosure provides an apparatus for simulating an open candle flame. The swing mechanism of the apparatus can minimize the cost and the number of parts, simplify the assembly, and insure the flame display stays in place after manufacturing and during transit and handling.

Certain embodiments of the present disclosure provide an apparatus for simulating an open candle flame comprising: a casing; a connecting rod; a flame display located above the casing and attached to an upper end of the connecting rod; a light source located within the flame display or connecting to the casing for generating light to illuminate the flame display; a balance weight attached to a lower end of the connecting rod; a swing holder located within the casing and engaging with the connecting rod, the connecting rod pivotally and rotatably connecting to the swing holder to form a first pivot structure for allowing the connecting rod to turn about a first axis, the swing holder pivotally and rotatably connecting to the casing to form a second pivot structure for allowing the swing holder and the connecting rod to turn about a second axis; a magnet attached to the balance weight; and a coil located adjacent to the magnet for generating an electromagnetic field interacting with a magnetic field of the magnet for driving the connecting rod to turn about the first axis and the second axis so as to swing the flame display for simulating the open candle flame.

In certain embodiments, the connecting rod comprises two rod protrusions located along the first axis; and the swing holder comprises two holder slots located along the first axis, the two rod protrusions being located within the two holder slots to form two first swing joints respectively thereby forming the first pivot structure.

In certain embodiments, the swing holder comprises two holder protrusions located along the second axis; and the casing comprises two casing slots located along the second axis, the two holder protrusions being located within the two casing slots to form two second swing joints respectively thereby forming the second pivot structure.

In certain embodiments, the two rod protrusions are attached to lateral sides of the connecting rod respectively; and the two holder slots are located on lateral sides of the swing holder respectively.

In certain embodiments, the two holder protrusions are attached to lateral sides of the swing holder respectively; and the two casing slots are located at lateral sides of the casing respectively.

In certain embodiments, the rod protrusion is cylindrical, round, polygon-shaped or in any other shapes.

In certain embodiments, the rod protrusion has an edge for contacting to the holder slot so as to reduce friction during the swinging of the connecting rod.

In certain embodiments, the holder slot is open-ended so as to facilitate the assembling between the connecting rod and the swing holder. The open-ended holder slot can be substantially circular, spiral-shaped, V-shaped, or in any other shapes. The V-shaped holder slot can have an angle greater than an angle of the edge of the rod protrusion.

In certain embodiments, the open-ended holder slot has an opening having a width smaller than the width of the rod protrusion.

In certain embodiments, the holder slot is circular, rectangular, square, polygon-shaped, or in any other shapes.

In certain embodiments, the holder protrusion is cylindrical, round, polygon-shaped, or in any other shapes.

In certain embodiments, the holder protrusion has an edge for contacting to the casing slot so as to reduce friction during the swinging of the swing holder.

In certain embodiments, the casing slot is circular, rectangular, square, polygon-shaped, or in any other shapes.

In certain embodiments, the first axis is substantially perpendicular to the second axis.

In certain embodiments, an angle between the first axis and the second axis is between 80° and 100°.

In certain embodiments, the connecting rod has a cross-section being circular, rectangular, square, round, polygon-shaped, or in any other shapes. In certain embodiments, the connecting rod comprises a plastic, a metal, or any other materials.

In certain embodiments, the swing holder is rectangular, square, round, circular, polygon-shaped, or in any other shapes. In certain embodiments, the swing holder comprises a plastic, a metal, or any other materials.

In certain embodiments, the swing holder has a hole for accommodating the connecting rod.

In certain embodiments, the balance weight is cylindrical, rectangular, cubic, round, polygon pillar shaped, or any other shapes. In certain embodiments, the balance weight comprises a metal, a plastic, or any other materials.

In certain embodiments, the balance weight is chamfered so as to reduce collision to the inner wall of the casing during the swinging of the balance weight.

In certain embodiments, the magnet is cylindrical, cubic, rectangular, or in any other shapes. In certain embodiments, the magnet is a permanent magnet.

In certain embodiments, the magnet is partially or fully enclosed by a hole of the balance weight.

In certain embodiments, the magnet lies along a vertical axis of the balance weight.

In certain embodiments, the coil is located below the magnet. The center of the coil can be located along the vertical axis of the magnet. The center of the coil can be offset from the vertical axis of the magnet so as to enhance the actuation of balance weight swinging.

In certain embodiment, the apparatus further comprises a driver for providing an electric current to the coil.

In certain embodiments, the driver is configured to generate an AC current or a pulsed DC current at a certain frequency. The pulsed DC current can be generated by pulse width modulation (PWM). The driver can generate the pulsed DC current with different pulse amplitudes and pulse durations to control the swing pattern of the flame display.

In certain embodiments, the flame display comprises a flame casing and the light source located within the flame casing.

FIGS. 1A-1D depict an apparatus for simulating an open candle flame according to certain embodiments. The apparatus 100 comprises a flame display 101, an upper case 102, a lower case 103, a lens 104, a light emitting diode (LED) 105, a lighting holder 106, a balance weight 107, two first swing joints 108*a*, 108*b*, two second swing joints 109*a*, 109*b*, a coil 110, a battery box 111, a connecting rod 112, a swing holder 113, and a printed circuit board (PCB) 114.

The flame display 101 is illuminated by the LED 105 through the lens 104. The LED 105 and the lens 104 are located within the lighting holder 106. One end of the connecting rod 112 is connected to the flame display 101 and another end of the connecting rod 112 is connected to the balance weight 107. The first swing joints 108*a*, 108*b* are located on opposite lateral sides of the connecting rod 112 along a first axis respectively to form a first pivot structure, and the second swing joints 109*a*, 109*b* are located on opposite lateral sides of swing holder 113 along a second axis respectively to form a second pivot structure.

The first swing joint 108*a* comprises a rod protrusion 117*a* of the connecting rod 112 and a holder slot 115*a* of the swing holder 113, the rod protrusion 117*a* is attached to the lateral side of the connecting rod 112 along the first axis, and the holder slot 115*a* is located at the lateral side of the swing holder 113 along the first axis. The first swing joint 108*b* comprises a rod protrusion 117*b* of the connecting rod 112 and a holder slot 115*b* of the swing holder 113, the rod protrusion 117*b* is attached to another lateral side of the connecting rod 112 along the first axis, and the holder slot 115*b* is located at another lateral side of the swing holder 113 along the first axis.

The second swing joint 109*a* comprises a holder protrusion 118*a* of the swing holder 113 and a casing slot 116*a* of the lower case 103, the holder protrusion 118*a* is attached to the lateral side of the swing holder 113 along the second axis, and the casing slot 116*a* is located at the lateral side of the lower case 103 along the second axis. The second swing joint 109*b* comprises a holder protrusion 118*b* of the swing holder 113 and a casing slot 116*b* of the lower case 103, the holder protrusion 118*b* is attached to another lateral side of the swing holder 113 along the second axis, and the casing slot 116*a* is located at another lateral side of the lower case 103.

In this embodiment, the casing slots 116*a*, 116*b* are located on the top edge of the lower case 103 and closed by the bottom edge of the upper case 102 that can prevent the holder protrusions 118*a*, 118*b* from coming loose to secure the swing holder 113 well in place.

Figure 1B:
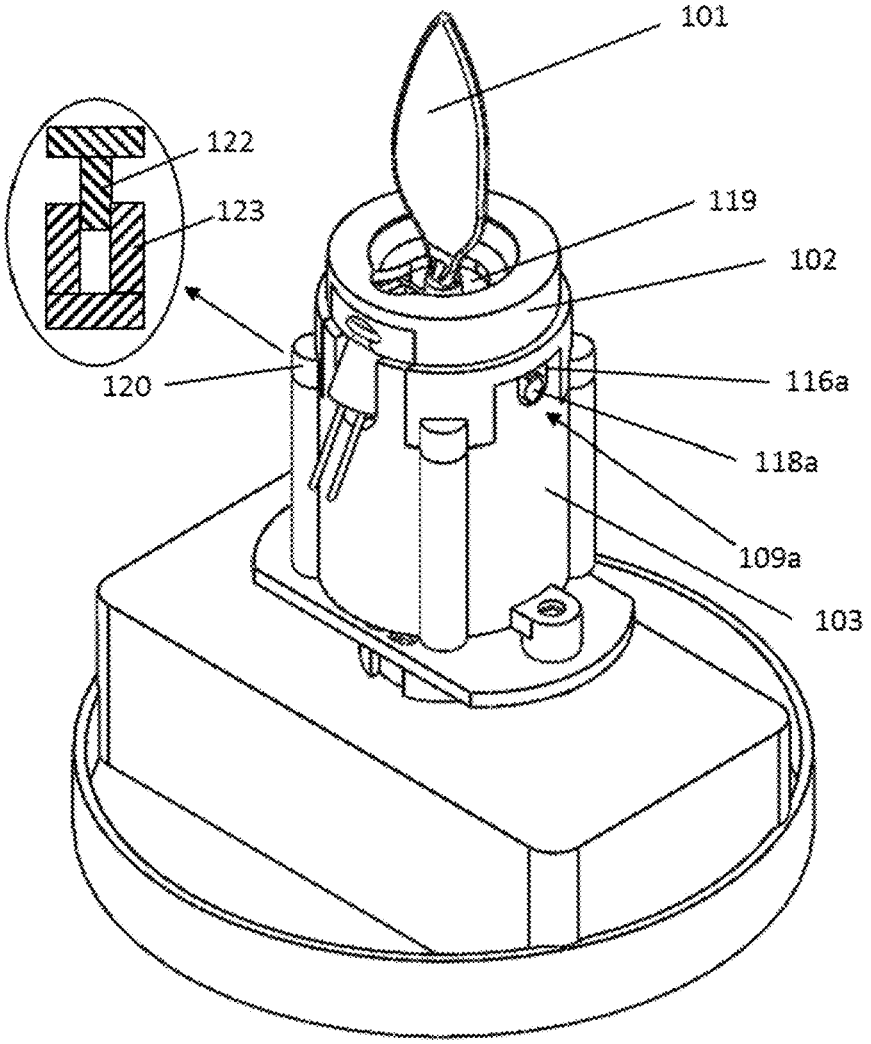
FIG. 1B is a schematic diagram depicting the apparatus of FIG. 1A covered with the upper case and the lower case.

In this embodiment, the upper case 102 and the lower case 103 are connected by pin and socket structures 120 including small pins 122 and sockets 123 (as shown in the inset of FIG. 1B) which allow assembly without glue, thereby reducing assembly labor. In certain embodiments, such pin and socket structure 120 can also be used to align the PCB and coil with the pendulum structure, and the pin structure can be adapted to have different sizes to support for different-sized candles.

In this embodiment, the lighting holder 106 is located between the upper case 102 and the lower case for facilitating the assembly of the apparatus 100.

As shown in FIGS. 1A and 1B, the upper case 102 has a top hole 119 having a first width being large enough to allow the flame display 101 to pass through the top hole 119 during assembly of the upper case 102 to the lower case 103, and a second width being small enough to prevent the first pivot structure and/or the balance weight 107 from passing through the top hole 119 after the assembly of the upper case 102 to its final position by rotation. For example, the upper case 102 is rotated with 90° from its final position during assembly to allow the flame display 101 to pass through. Once the upper case 102 is rotated and positioned to its final position, this locks the first pivot structure and the balance weight 107 within the upper case 102 and lower case 103 and avoids the flame display 101 to be removed from the upper case 102, even if the first pivot structure comes loose from its snapped position.

A magnet (not shown in FIGS. 1A-1D) is attached to the bottom of the balance weight 107 and located between the balance weight 107 and the coil 110. The coil 110 is electrically connected to the PCB 114 having a driver for generating an electric current to the coil 110 for generating an electromagnetic field.

Figure 1C:
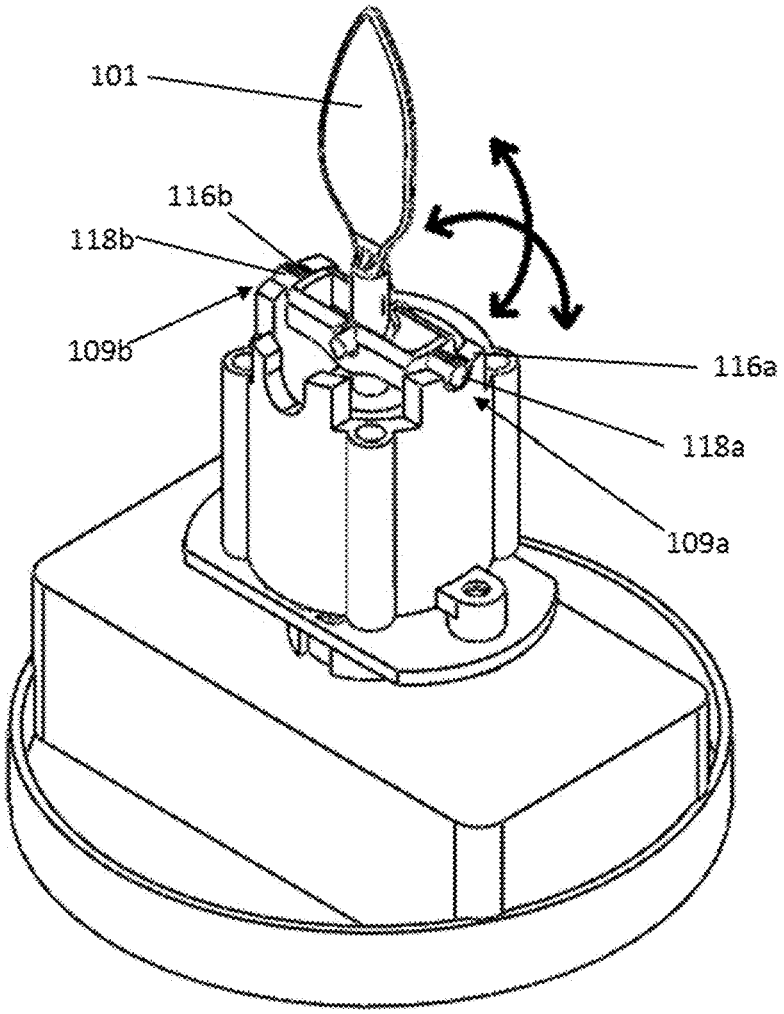
FIG. 1C is a schematic diagram depicting the apparatus of FIG. 1A when the flame display swings.
Figure 1D:
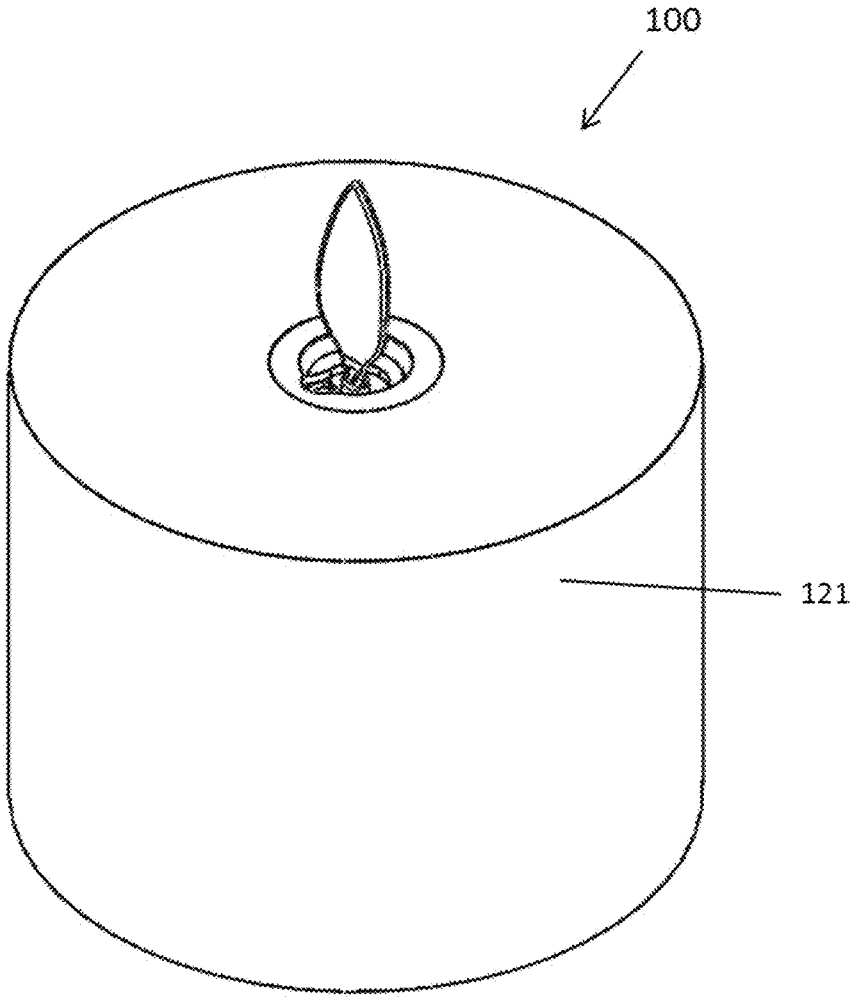
FIG. 1D is a schematic diagram depicting the apparatus of FIG. 1A having a housing.
Figure 2:
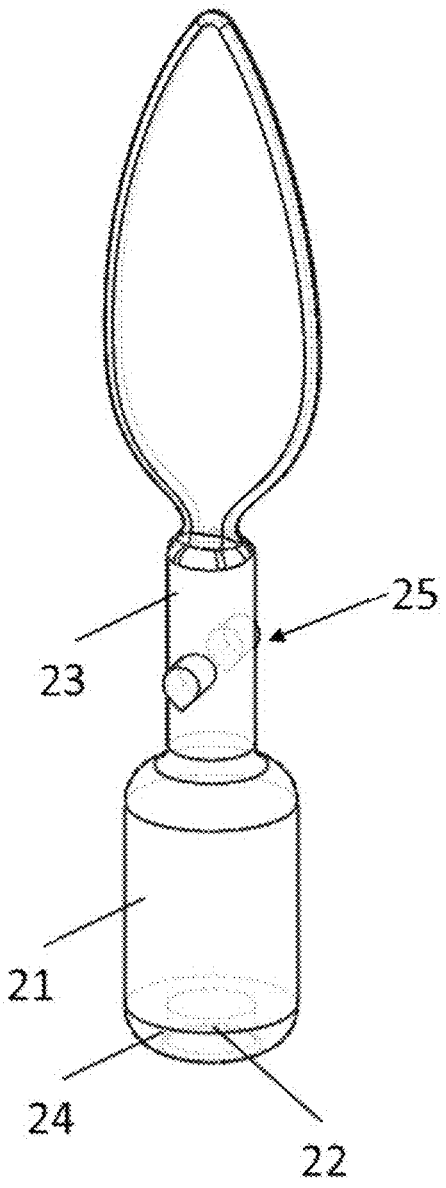
FIG. 2 is a schematic diagram depicting a pendulum structure of the apparatus according to certain embodiments.

When the electric current provided by the PCB 114 passes through the coil 110, the electromagnetic field is generated. Due to the interaction between the electromagnetic field from the coil 110 and the magnetic field from the magnet, the balance weight 107 swings. Under the leverage of the connecting rod 112 in view of the first pivot structure and the second pivot structure, the flame display 101 swings with the balance weight 107 along the first axis and the second axis as shown in FIG. 1C. Under such actuation means, the swing of the flame display 101 is more obvious. FIG. 1D shows the apparatus 100 further including a housing 121. The housing 121 can comprise wax, plastic, glass, resin, ceramic, metal, fabric, paper, wood, silicone, or any other materials. FIG. 2 is a schematic diagram depicting a pendulum structure of the apparatus according to certain embodiments. The balance weight 21 is cylindrical and the upper and lower edges of the balance weight 21 are chamfered. A cylindrical permanent magnet 22 is attached to a bottom end of the balance weight 21 along the vertical axis of the balance weight 21 and partially enclosed within a hole 24 of the balance weight 21. A connecting rod 23 is attached to a top end of the balance weight 21. The balance weight 21 is suspended from a first pivot structure 25 so that it can swing.

Figure 3A:
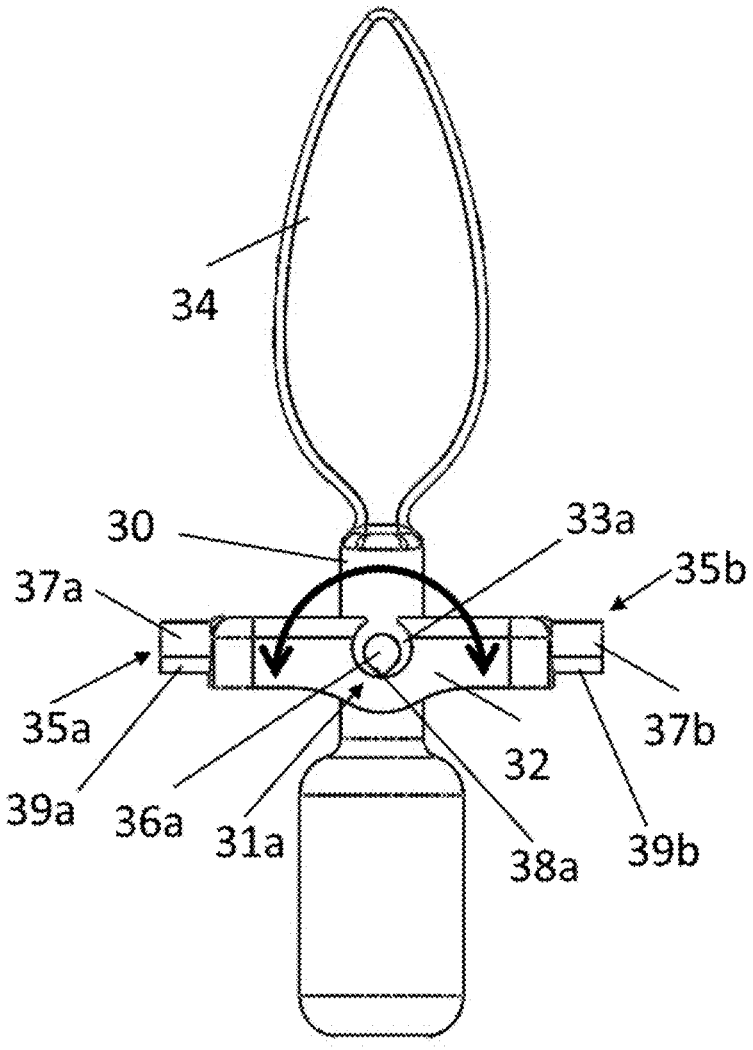
FIG. 3A is a schematic diagram depicting a swing mechanism when a flame display swings about a first axis according to certain embodiments.
Figure 3B:
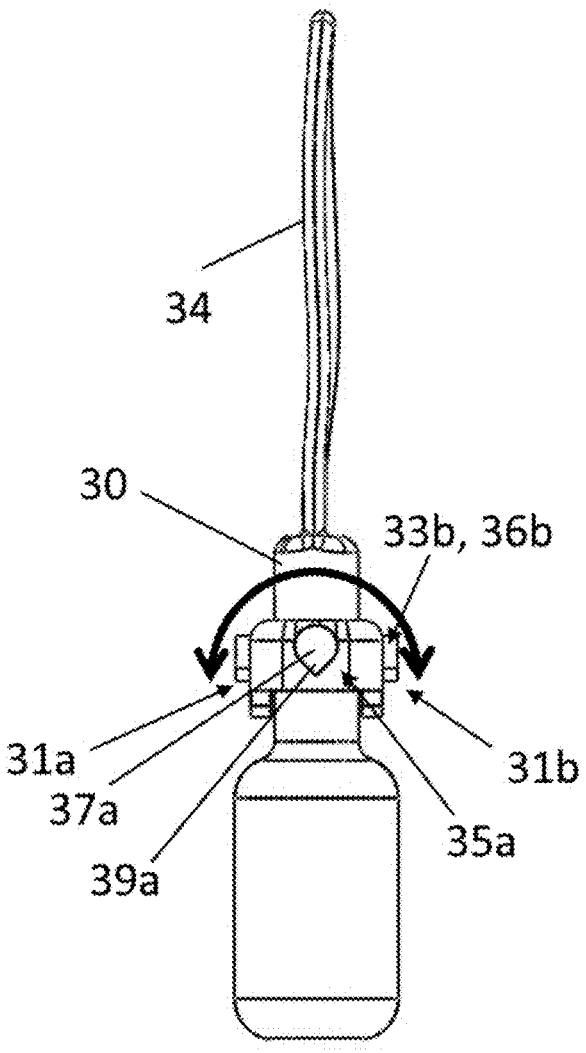
FIG. 3B is a schematic diagram depicting the swing mechanism of FIG. 3A when the flame display swings about a second axis.

FIGS. 3A and 3B depict a swing mechanism of the apparatus when a flame display swings about a first axis and a second axis. Two first swing joints 31*a*, 31*b* are oppositely located on lateral sides of a connecting rod 30 along the first axis to form a first pivot structure. The first swing joint 31*a* comprises a rod protrusion 36*a* of the connecting rod 30 and a holder slot 33*a* of a swing holder 32. The first swing joint 31*b* comprises a rod protrusion 36*b* of the connecting rod 30 and a holder slot 33*b* of the swing holder 32. The swing holder 32 has a hole in the middle for accommodating the connecting rod 30. Subjecting to the electromagnetic field generated from a coil, a flame display 34 swings about the first axis and the second axis.

In this embodiment, the holder slot 33*a* has a width opening being slightly smaller than the rod protrusion 36*a* such that the pendulum structure together with the flame display 34 can snap to the swing holder 32 in place. This snap makes assembly very easy, while also preventing the flame display 34 from coming loose from the first pivot structure. Similarly, the holder slots 33*b* has a width opening (not shown in FIGS. 3A and 3B) being slightly smaller than the rod protrusion 36*a* to provide the same function.

In this embodiment, the rod protrusion 36*a* has an edge 38*a* for contacting to the holder slot 33*a* to provide a point contact between the holder slot 33*a* and the rod protrusion 36*a* in the first pivot structure so as to provide a very low friction mechanism that allows the free movement of the pendulum structure and ease of assemble. Similarly, the rod protrusion 36*b* also has an edge (not shown in FIGS. 3A and 3B) to provide the same function.

Two second swing joints 35*a*, 35*b* are oppositely located on lateral sides of the swing holder 32 along the second axis to form a second pivot structure. The second swing joint 35*a* comprises a holder protrusion 37*a* of the swing holder 32 and a casing slot of a casing (not shown in FIGS. 3A and 3B). The second swing joint 35*b* comprises a holder protrusion 37*b* of the swing holder 32 and another casing slot of the casing (not shown in FIGS. 3A and 3B). The axis of the two second swing joints 35*a*, 35*b* is perpendicular to the axis of the two first swing joints 31*a*, 31*b*. Subjecting to the electromagnetic field generated from a coil, the swing holder 32 turns about the second axis simultaneously applying force to the two first swing joints 31*a*, 31*b* to drive the connecting rod 30 to turn about the second axis. Under the combination of the first pivot structure and the second pivot structure, the flame display 34 can swing about the first axis and the second axis in large amplitudes.

In this embodiment, the holder protrusion 37*a* has an edge 39*a* for contacting to the casing slot to provide a point contact between the casing slot and the holder protrusion 36*a*. Similarly, the holder protrusion 37*b* also has an edge 39*b* to provide the same function.

In certain embodiments, all of the first and second pivot structures are made using simple plastic parts that eliminates the need for metal axles such that the material cost and assembly steps can be reduced. In certain embodiments, the flame display and the pendulum structure are all molded in one piece, which can be easily assembled by rotating to pass through the hole of the swing holder. Once the flame display and the pendulum structure are fixed to the swing holder in position, it prevents the flame display and pendulum structure from coming out of the casing.

Figure 4A:
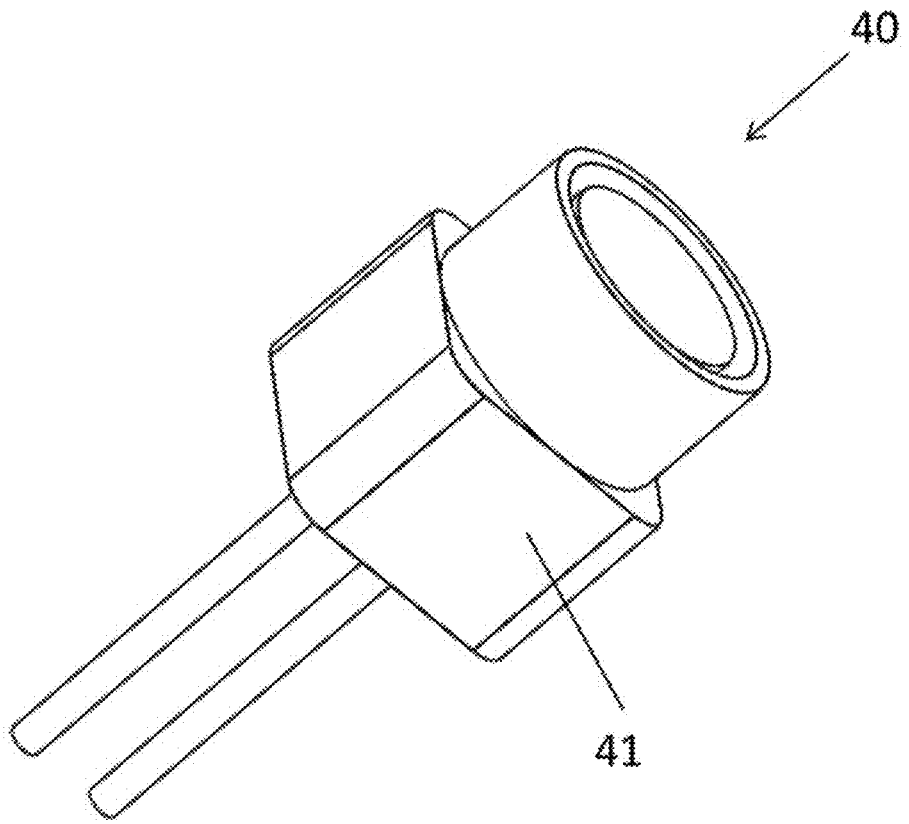
FIG. 4A is a schematic diagram depicting a lighting module according to certain embodiments.
Figure 4B:
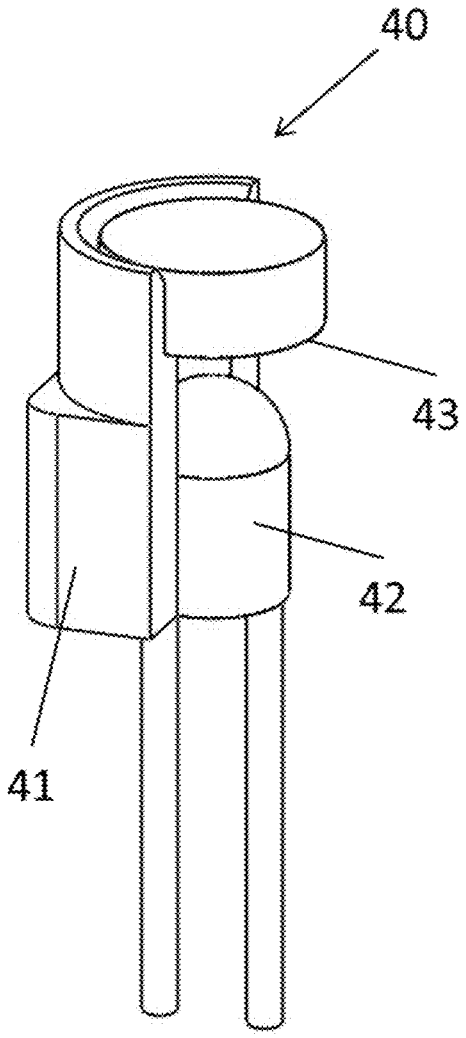
FIG. 4B is a schematic diagram showing another view of the lighting module of FIG. 4A.

FIGS. 4A and 4B depict a lighting module 40 comprising a lighting holder 41, a LED 42 and a lens 43. The LED 42 and the lens 43 are housed in the lighting holder 41.

Figure 5A:
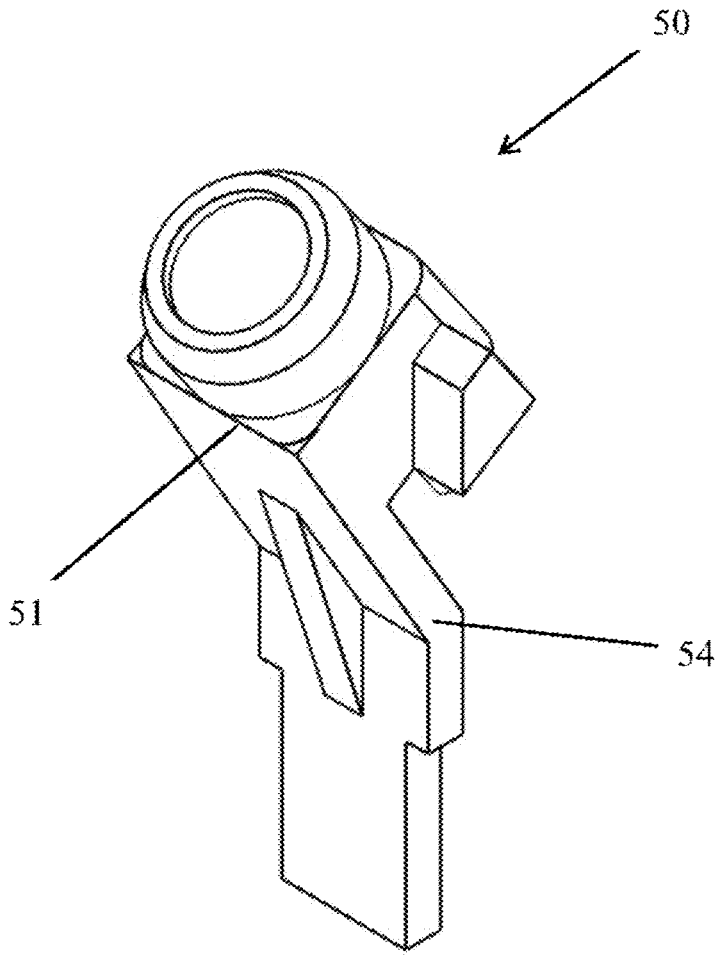
FIG. 5A is a schematic diagram depicting a lighting module according to certain embodiments.
Figure 5B:
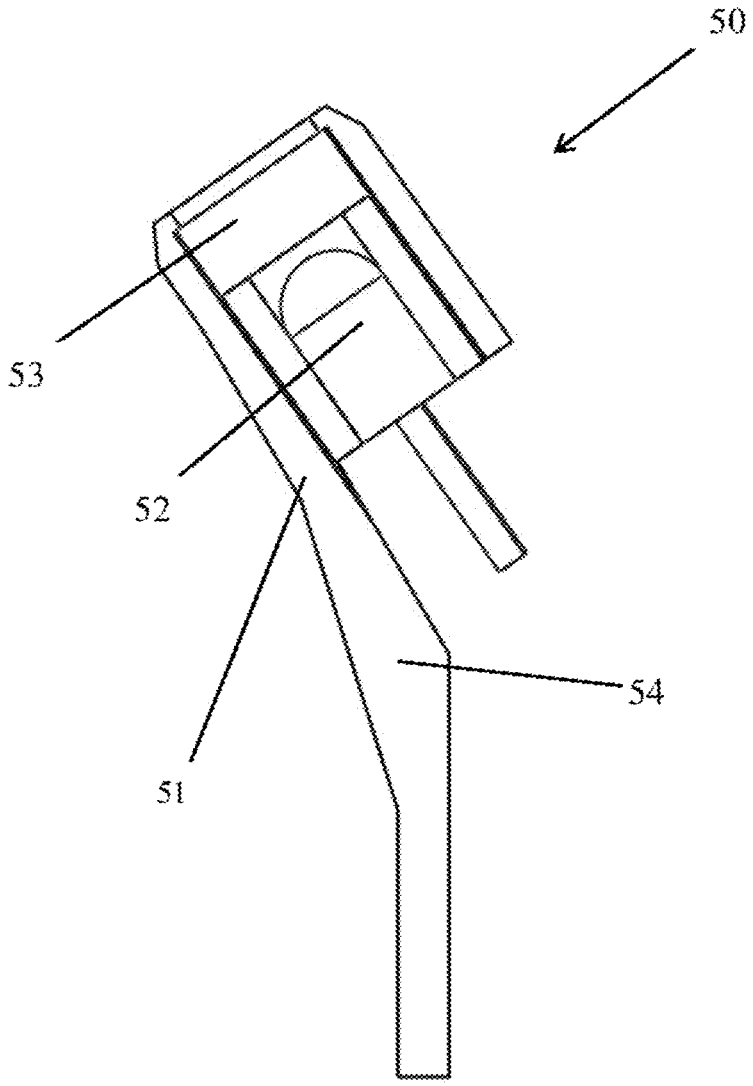
FIG. 5B is a schematic diagram showing another view of the lighting module of FIG. 5A.

FIGS. 5A and 5B depict a lighting module 50 comprising a lighting holder 51, a LED 52 and a lens 53. The LED 52 and the lens 53 are housed in the lighting holder 51. The lighting holder 51 has a bent portion 54 for facilitating the attachment of the lighting module 50 to the apparatus and illumination on the flame display.

Figure 6A:
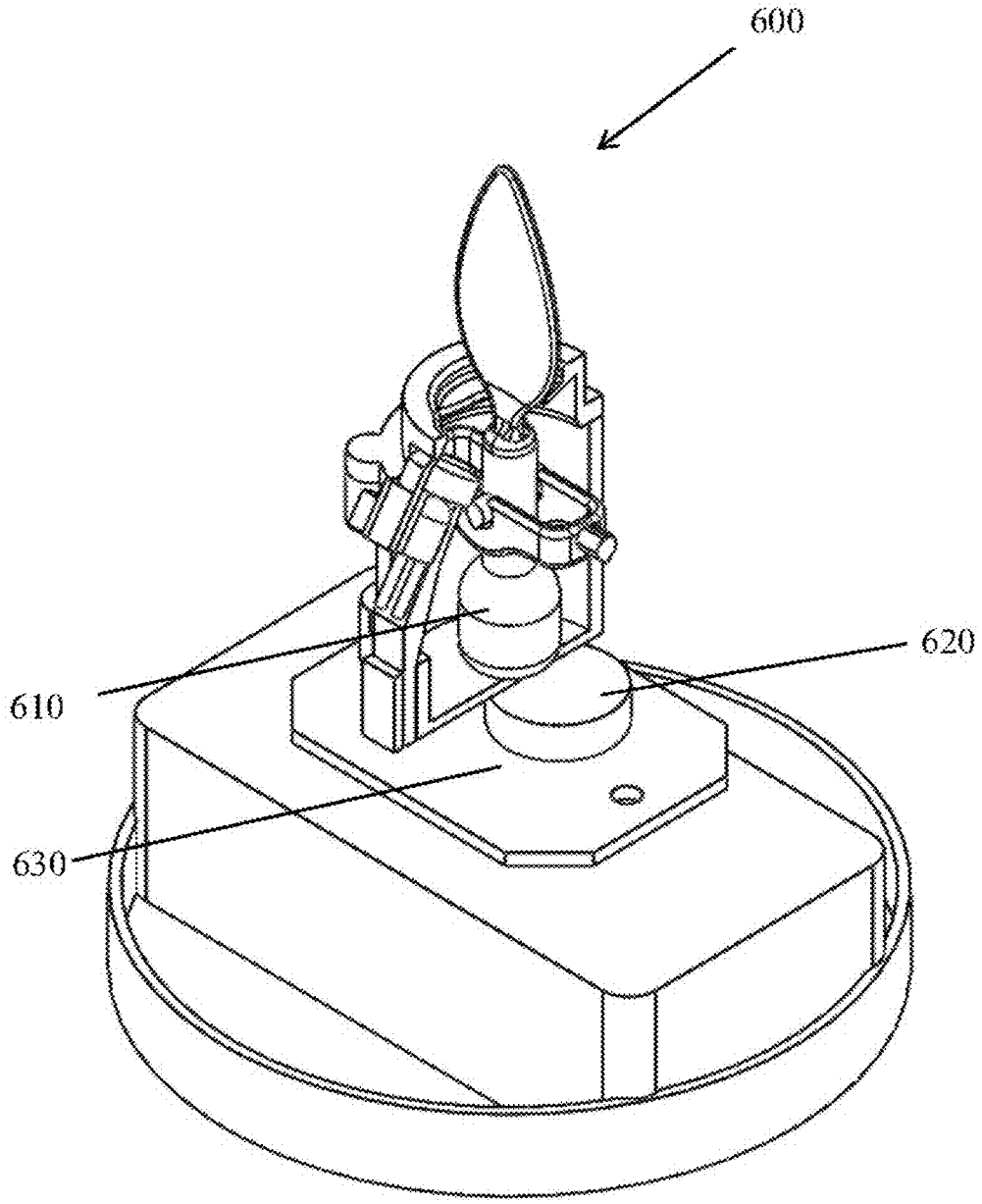
FIG. 6A is a schematic diagram depicting an apparatus for simulating an open candle flame according to certain embodiments.
Figure 6B:
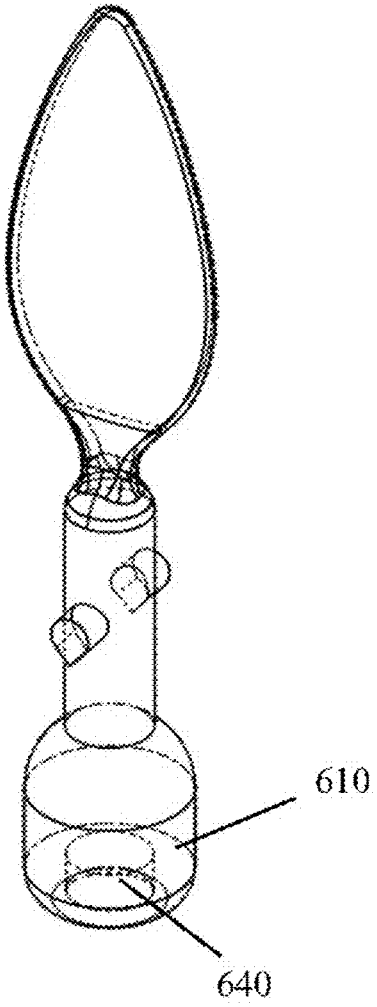
FIG. 6B is a schematic diagram depicting the pendulum structure of the apparatus of FIG. 6A.

FIGS. 6A and 6B depict an apparatus 600 for simulating an open candle flame according to certain embodiments. The apparatus 600 comprises a chamfered cylindrical body weight 610, a coil 620, a PCB 630 and a cylindrical magnet 640. The chamfered cylindrical body weight 610 has a hole located at the bottom of the chamfered cylindrical body weight 610. The cylindrical magnet 640 is attached to the hole. The coil 620 is located below the cylindrical magnet 640 with an offset distance between a center of the coil 620 and a vertical axis of the cylindrical magnet 640.

FIGS. 7A-7H depict an apparatus 700 for simulating an open candle flame with a self-illuminated flame display according to certain embodiments. The apparatus 700 comprises a self-illuminated flame display 701, an upper case 702, a lower case 703, a connecting rod 704, a swing holder 705, a balance weight 706, a magnet 707 (shown in FIG. 7E), a coil 708, a PCB 709, a battery box 710 and a housing 716.

The self-illuminated flame display 701 comprises a flame casing 711 and a LED 712. The flame casing 711 and the LED 712 are attached to the top end of the connecting rod 704 so that a light projecting module is not required in the embodiment.

Figure 7A:
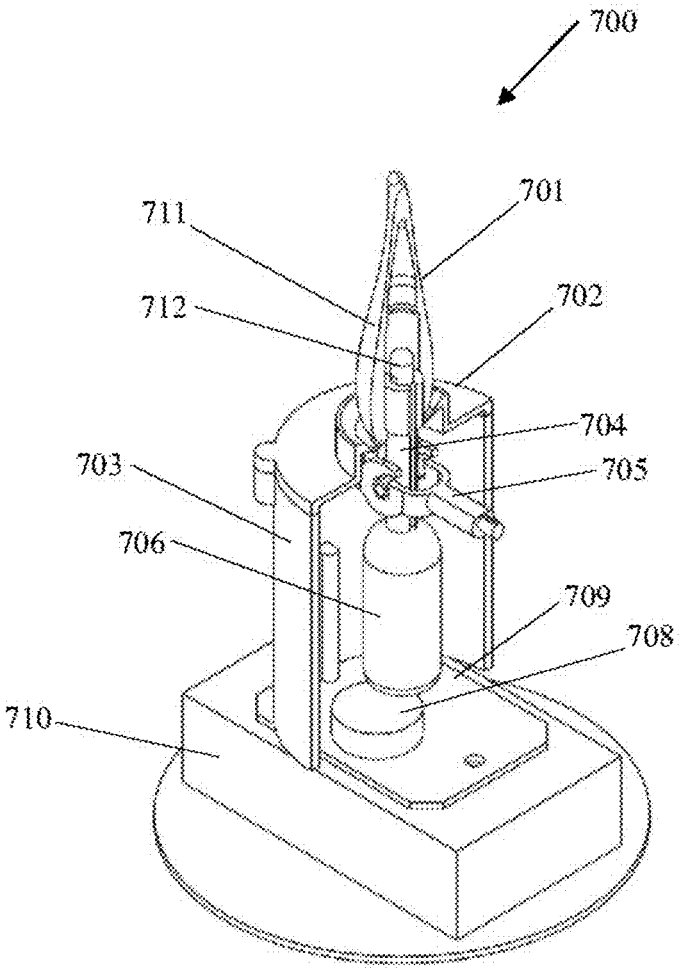
FIG. 7A is a schematic diagram depicting an apparatus for simulating an open candle flame with a self-illuminated flame display according to certain embodiments.
Figure 7B:
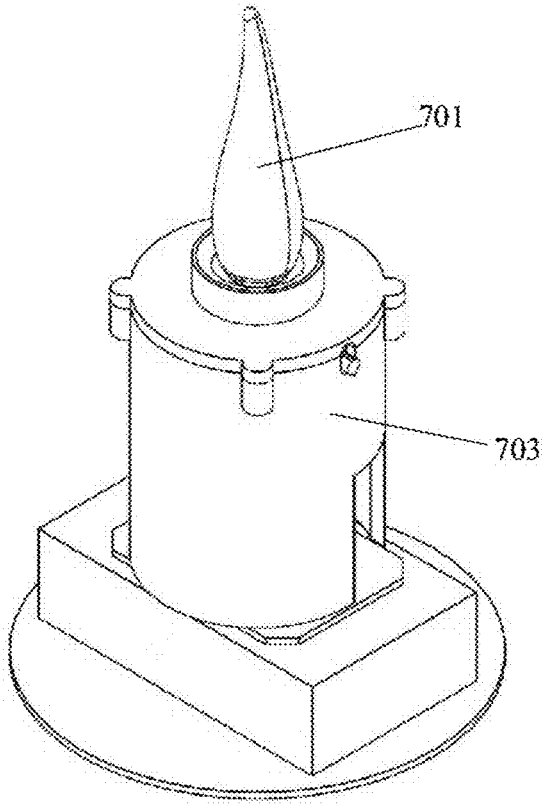
FIG. 7B is a schematic diagram depicting the apparatus of FIG. 7A covered by the upper case and the lower case.
Figure 7C:
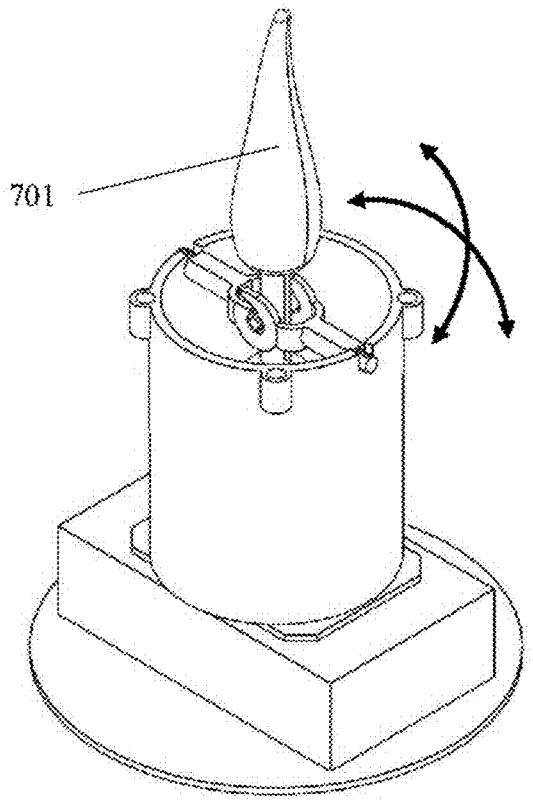
FIG. 7C is a schematic diagram depicting the apparatus of FIG. 7A when the flame display swings.
Figure 7D:
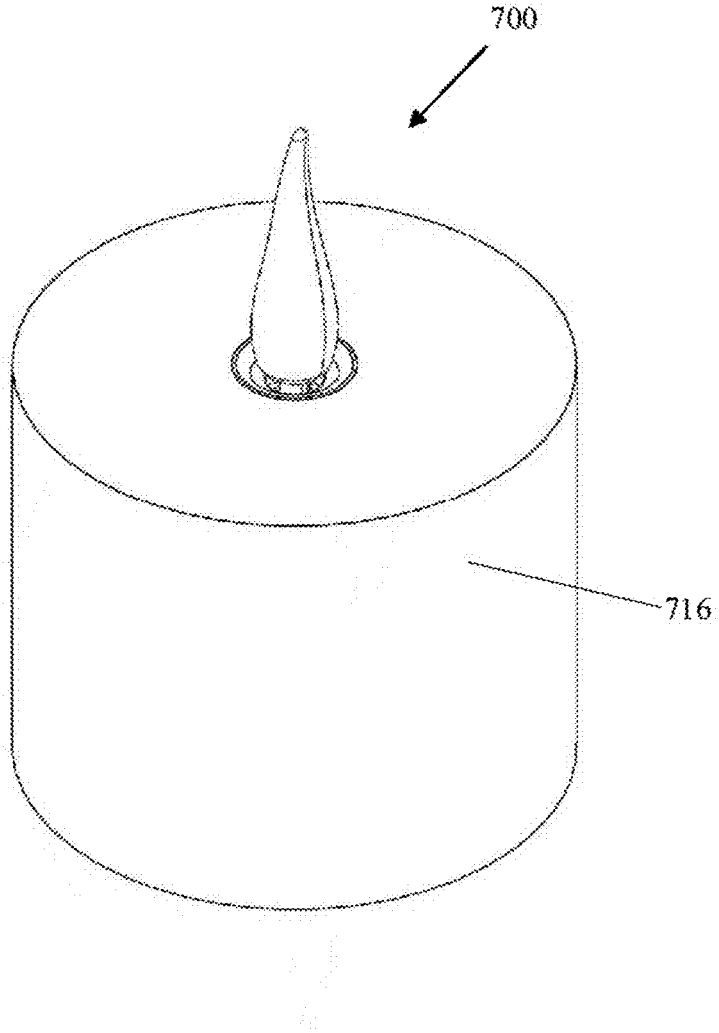
FIG. 7D is a schematic diagram depicting the apparatus of FIG. 7A having a housing.
Figure 7E:
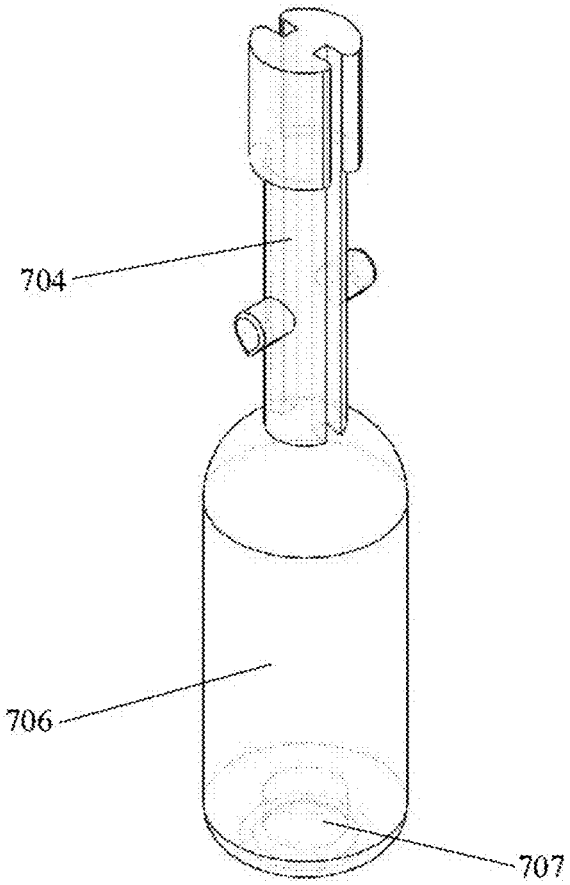
FIG. 7E is a schematic diagram depicting a pendulum structure of the apparatus of FIG. 7A.
Figure 7F:
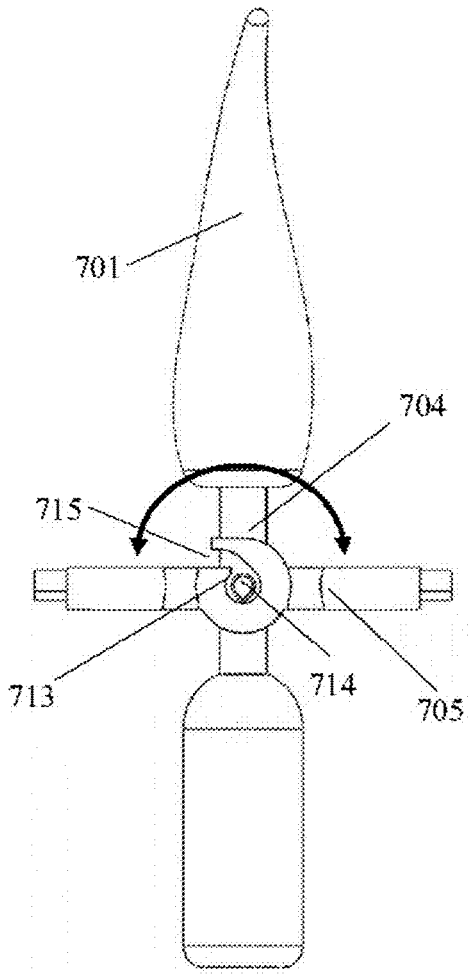
FIG. 7F is a schematic diagram depicting the swing mechanism of the apparatus of FIG. 7A when the flame display swings about the first axis.
Figure 7G:
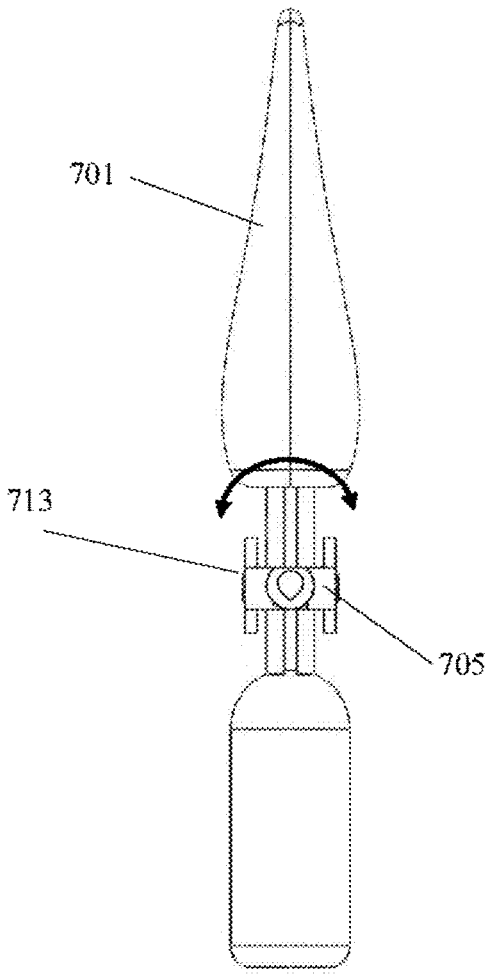
FIG. 7G is a schematic diagram depicting the swing mechanism of the apparatus of FIG. 7A when the flame display swings about the second axis.
Figure 7H:
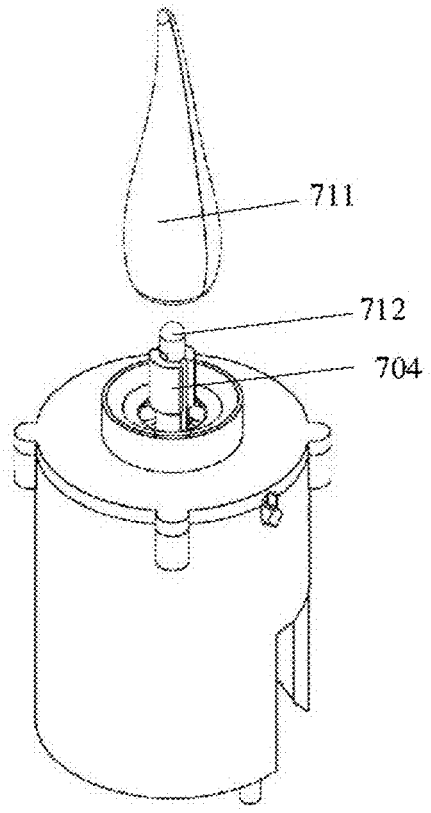
FIG. 7H is a schematic diagram depicting the self-illuminated flame display of the apparatus of FIG. 7A.

As shown in FIG. 7F, the swing holder 705 comprises two spiral-shaped holder slots 713 for engaging with two rod protrusions 714 of the connecting rod 704 respectively. The spiral-shaped holder slot 713 has an opening 715 with a width slightly less than a width of the rod protrusion 714 so as to secure the rod protrusion 714 within the spiral-shaped holder slot 713 to prevent the pivot structure from coming out from its snapped position. It also facilitates the assembling between the rod protrusion 714 and the spiral-shaped holder slot 713 by snapping the rod protrusion 714 into the spiral-shaped holder slot 713 via the opening 715.

Thus, it can be seen that an improved apparatus for simulating an open candle flame has been disclosed which eliminates or at least diminishes the disadvantages and problems associated with prior art apparatus. The swinging mechanism of the apparatus is able to minimize the cost and the number of parts, ease and simplify assembly, and insure the flame display stays in place after manufacturing and during transit and handling.

Although the invention has been described in terms of certain embodiments, other embodiments apparent to those of ordinary skill in the art are also within the scope of this invention. Accordingly, the scope of the invention is intended to be defined only by the claims which follow.

What is claimed is:

1. An apparatus for simulating an open candle flame comprising:

a casing;

a connecting rod;

a flame display located above the casing and attached to an upper end of the connecting rod;

a light source located within the flame display or connecting to the casing for generating light to illuminate the flame display;

a balance weight attached to a lower end of the connecting rod;

a swing holder located within the casing and engaging with the connecting rod, the connecting rod pivotally and rotatably connecting to the swing holder to form a first pivot structure for allowing the connecting rod to turn about a first axis, the swing holder pivotally and rotatably connecting to the casing to form a second pivot structure for allowing the swing holder and the connecting rod to turn about a second axis;

a magnet attached to the balance weight; and a coil located adjacent to the magnet for generating an electromagnetic field interacting with a magnetic field of the magnet for driving the connecting rod to turn about the first axis and the second axis so as to swing the flame display for simulating the open candle flame;

wherein the connecting rod comprises two rod protrusions located along the first axis; and the swing holder comprises two holder slots located along the first axis, the two rod protrusions being located within the two holder slots to form two first swing joints respectively thereby forming the first pivot structure; and wherein each of the two holder slots is spiral-shaped, the spiral-shaped holder slot having an opening, the opening having a width slightly less than a width of a respective rod protrusion for allowing the respective rod protrusion to be snapped into the spiral-shaped holder slot such that the respective rod protrusion is secured within the spiral-shaped holder slot in view of the opening and a spiral shape of the spiral-shaped holder slot so as to prevent the first pivot structure from coming out from a snapped position, at which the respective rod protrusion is snapped into the spiral-shaped holder slot via the opening.

2. The apparatus of claim 1, wherein the swing holder comprises two holder protrusions located along the second axis; and the casing comprises two casing slots located along the second axis, the two holder protrusions being located within the two casing slots to form two second swing joints respectively thereby forming the second pivot structure.

3. The apparatus of claim 2, wherein the two holder protrusions are attached to lateral sides of the swing holder respectively; and the two casing slots are located at lateral sides of the casing respectively.

4. The apparatus of claim 2, wherein each of the holder protrusions has an edge for contacting a respective casing slot.

5. The apparatus of claim 2, wherein each of the casing slots is circular or V-shaped.

6. The apparatus of claim 2, wherein the casing comprises an upper case and a lower case.

7. The apparatus of claim 6, wherein each of the casing slots is located on the top edge of the lower case and closed by the bottom edge of the upper case so as to prevent the holder protrusions from coming loose.

8. The apparatus of claim 6, wherein the upper case and the lower case are connected by a plurality of pins and sockets.

9. The apparatus of claim 6, wherein the upper case has a top hole having a first width and a second width, the first width being large enough to allow the flame display to pass through the top hole, the second width being small enough to prevent the first pivot structure to pass through after rotating the upper case to a final position of assembly.

10. The apparatus of claim 6 further comprising a light holder and lens, the light source and the lens being located within the light holder, the light holder being located between the upper case and the lower case, the lens being used for focusing the light on the flame display.

11. The apparatus of claim 1, wherein the two rod protrusions are attached to lateral sides of the connecting rod respectively; and the two holder slots are located at lateral sides of the swing holder respectively.

12. The apparatus of claim 1, wherein the first axis is substantially perpendicular to the second axis.

13. The apparatus of claim 1, wherein an angle between the first axis and the second axis is between 80° and 100°.

14. The apparatus of claim 1, wherein each of the rod protrusions has an edge for contacting a respective holder slot.

15. The apparatus of claim 1, wherein the coil is located below the magnet.

16. The apparatus of claim 1, wherein the center of the coil is offset from a vertical axis of the magnet with an offset distance.

17. The apparatus of claim 1, wherein the electromagnetic field is a time-varying electromagnetic field.

18. The apparatus of claim 1 further comprising a driver for providing electric current to the coil.

19. The apparatus of claim 18 further comprising a printed circuit board containing the driver.

20. The apparatus of claim 1 further comprising a light holder and lens, the light source and the lens being located within the light holder, the light holder attached to the casing, the lens being used for focusing the light on the flame display.

21. The apparatus of claim 1, wherein the flame display comprises a flame casing, the light source being located within the flame casing.

22. The apparatus of claim 1 further comprising a housing, the casing being located within the housing, the flame display being located above or on the surface of the housing.

* * * * *